US007234846B2

(12) United States Patent
Chen

(10) Patent No.: US 7,234,846 B2
(45) Date of Patent: Jun. 26, 2007

(54) STRUCTURE OF EMBEDDED LAMP HAVING REPLACEABLE LIGHT BULB

(75) Inventor: Yen-Chang Chen, Taipei Hsien (TW)

(73) Assignee: Variable Luminaire Ltd., Taipei Hsien (TW)

( * ) Notice: Subject to any disclaimer, the term of this patent is extended or adjusted under 35 U.S.C. 154(b) by 113 days.

(21) Appl. No.: 11/099,645

(22) Filed: Apr. 6, 2005

(65) Prior Publication Data

US 2006/0227560 A1 Oct. 12, 2006

(51) Int. Cl.
*F21V 11/00* (2006.01)

(52) U.S. Cl. ..... 362/365; 362/368; 362/287; 362/372; 362/427

(58) Field of Classification Search ..... 362/364, 362/365, 372, 368, 370, 806, 285, 287, 418, 362/427
See application file for complete search history.

(56) References Cited

U.S. PATENT DOCUMENTS 4,142,227 A * 2/1979 Aikens ..... 362/480
5,377,087 A * 12/1994 Yoon ..... 362/275
5,465,199 A * 11/1995 Bray et al. ..... 362/364
5,909,955 A * 6/1999 Roorda ..... 362/368
6,457,848 B1 * 10/2002 Wolf et al. ..... 362/364
2006/0109660 A1 * 5/2006 Wolf et al. ..... 362/365

* cited by examiner

*Primary Examiner*—Thomas M. Sember
(74) *Attorney, Agent, or Firm*—Troxell Law Office, PLLC

(57) ABSTRACT

An embedded lamp comprises a base, an embedded bracket, a lamp socket, and a decorative plate, wherein a flange is formed on the internal periphery of a rotatable bracket of the embedded bracket for coupling with the decorative plate. A protrudent ring having at least a pair of buckling means having a pair of protrudent elastic buckles is mounted on the internal periphery of the decorative plate. When the decorative plate is inserted into the rotatable bracket, the protrudent elastic buckles are bounded to buckle the flange and to be positioned thereon. By means of the above-mentioned structure, the decorative plates with different internal diameter dimensions can be replaced with one another according to the diameter dimensions of various light bulbs without detaching the base and the embedded bracket. Accordingly, it facilitates the replacement of the light bulbs without need of high maintenance technique.

3 Claims, 6 Drawing Sheets

STRUCTURE OF EMBEDDED LAMP HAVING REPLACEABLE LIGHT BULB

FIELD OF THE INVENTION

The present invention relates to an embedded lamp, which is widely applicable to light bulbs with various specifications, and more particularly to an embedded lamp having a conveniently detachable decorative plate to facilitate the replacement of the light bulbs with various specifications.

BACKGROUND OF THE INVENTION

The embedded lamp has very widespread applications and is suitable for a cupboard, a ceiling, a wall, etc. The light emitted from the embedded lamp makes the consumer feel that the indoor location is softer than before. The conventional embedded lamp is usually inserted into a hole, which is formed by digging the ceiling, the wall, or the cupboard in advance. Besides, the embedded lamp and the wall, for example, form a flat surface jointly. Since the light bulb attached to the base of the embedded lamp is compliant with a designated specification, a light bulb having a specific watt value is put to use together with a specific lamp socket. If the diameter dimension of the light bulb is too small or too large, a specific lamp socket must be put to use.

SUMMARY OF THE INVENTION

In view of the drawbacks of the conventional structure in which the light bulb and the lamp socket are usually unmatched with one another, the present inventor improves the conventional structure and provides a structure of an embedded lamp in which the light bulb can be changed without use of any tool for satisfying the use requirement of the industry.

It is a main object of the present invention to provide a structure of an embedded lamp having a replaceable light bulb. The decorative plate can be changed according to the diameter dimensions of the light bulbs. There is no need to detach the base and the embedded socket so the consumer can change the light bulb in absence of high maintenance technique.

It is another object of the present invention to provide a structure in which the light bulb can be changed without use of any tool. The decorative plate has elastic buckles so it is easy to buckle up the elastic buckles and the flange of the rotatable bracket. Accordingly, the decorative plate can be easily detached without use of any tool.

Other objects and features of the present invention will become apparent from the following detailed description when taken in conjunction with the drawings in which:

DETAILED DESCRIPTION OF THE PREFERRED EMBODIMENT

The above-mentioned features and advantages of this invention, and the manner of attaining them, will become more apparent and the invention will be better understood by reference to the following description of embodiments of the invention taken in conjunction with the drawings.

Figure 1:
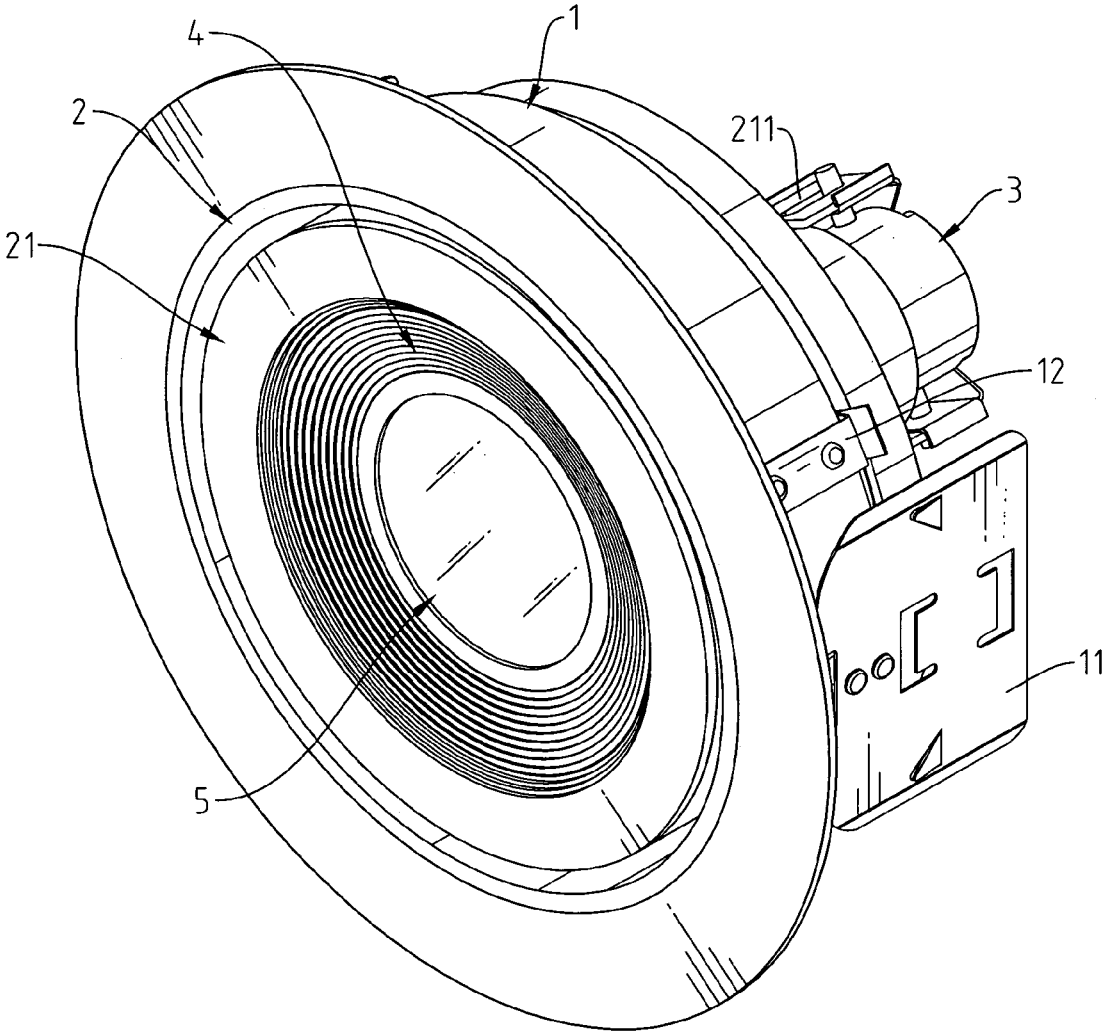
FIG. 1 is an elevational view showing the present invention.
Figure 2:
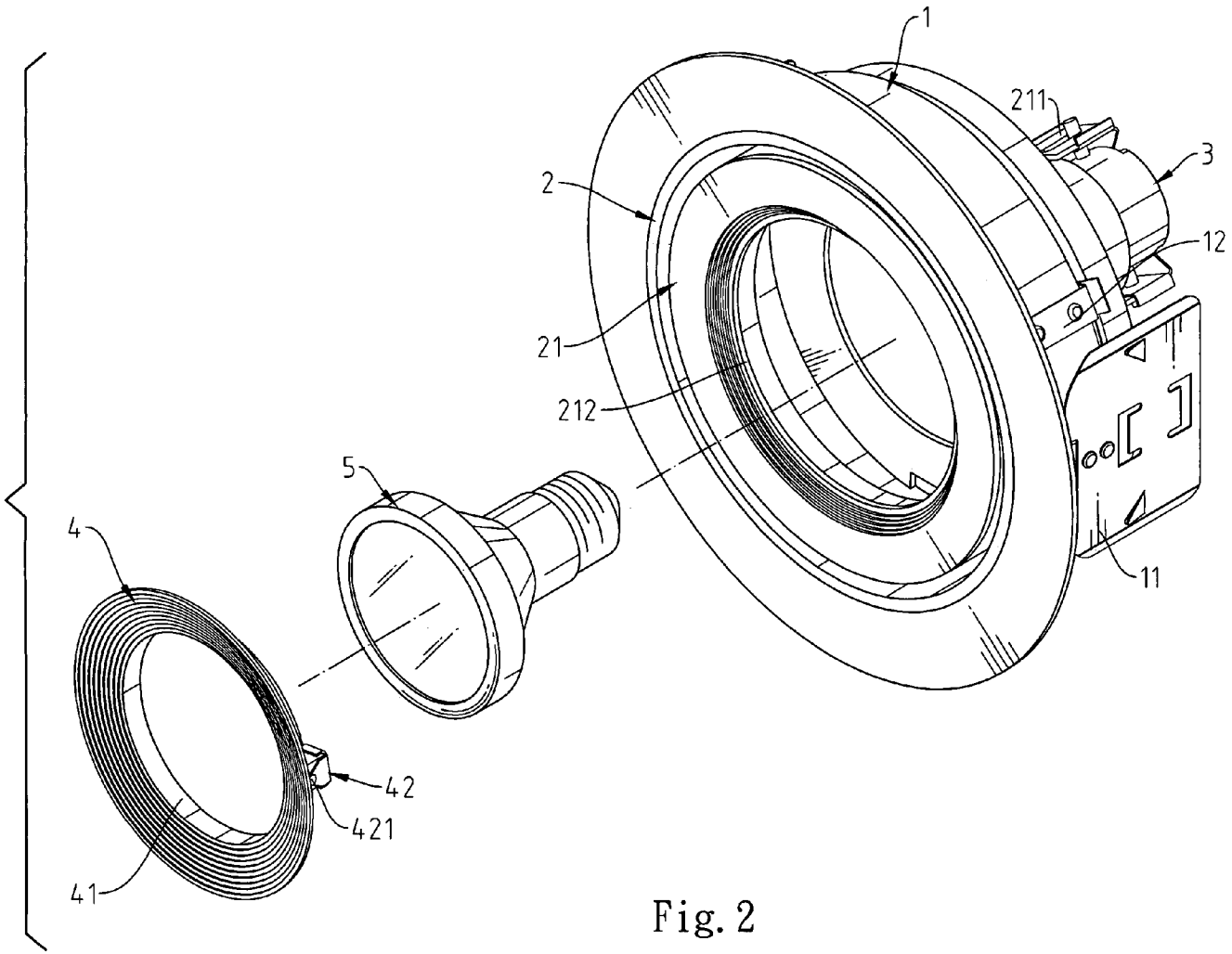
FIG. 2 is an elevational exploded view showing the partial structure of present invention.
Figure 3:
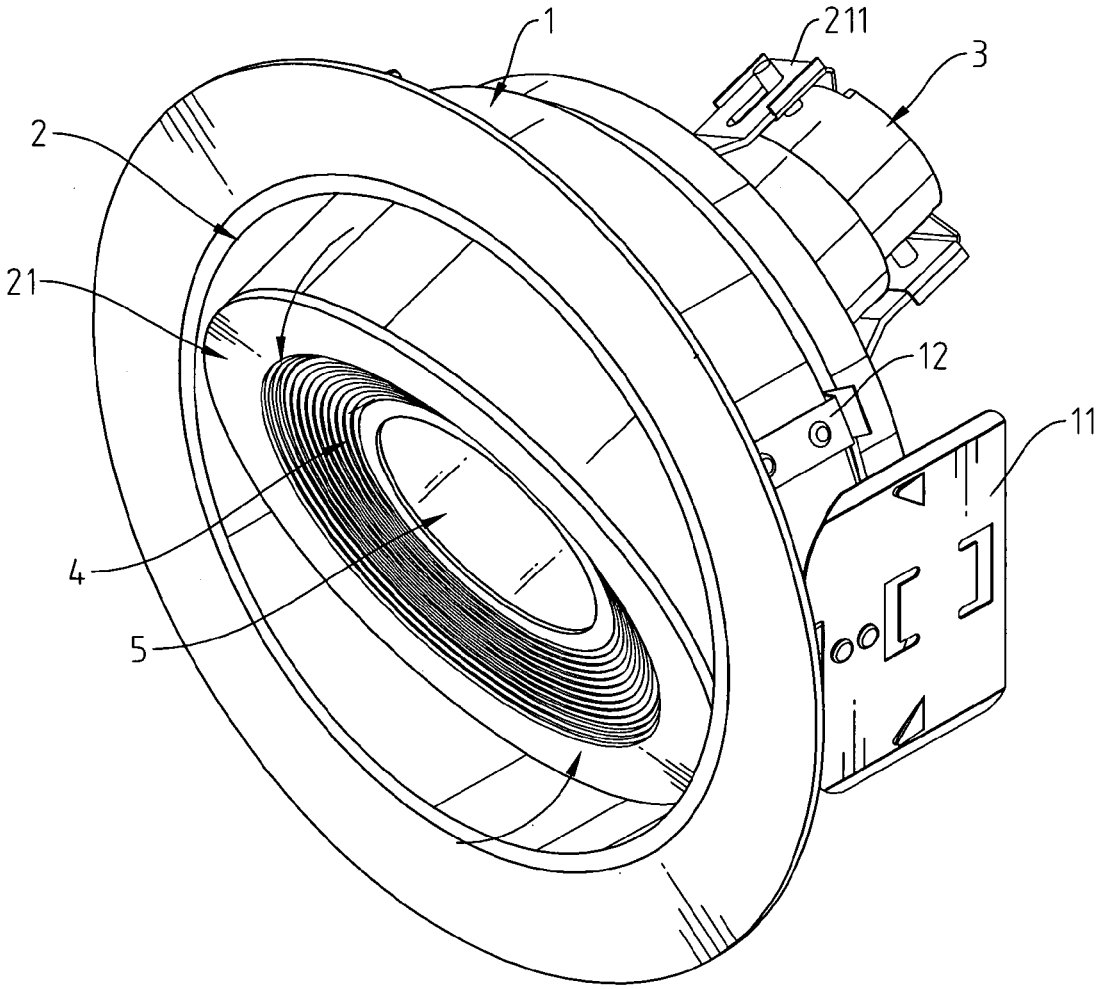
FIG. 3 is an elevational view showing that the angle is changeable in accordance with the preferred embodiment of the present invention.

Referring to FIG. 1 through FIG. 3, a structure of an embedded lamp having a replaceable light bulb of the present invention comprises a base 1, an embedded bracket 2, a lamp socket 3, and a decorative plate 4, wherein the embedded bracket 2 is mounted on the inside of the base 1, and a positioning plate 11 mounted on the lateral portion of the base 1 is designed to securely position the base 1. When the embedded bracket 2 is positioned on the inside of the base 1, a locking plate 12 mounted on the base 1 is coupled with the embedded bracket 2. In addition, a rotatable bracket 21 is further mounted on the inside of the embedded bracket 2, wherein two connecting plates 211 are mounted on the end of the rotatable bracket 21 to securely connect to the lamp socket 3 to which a light bulb 5 is attached.

Figure 4:
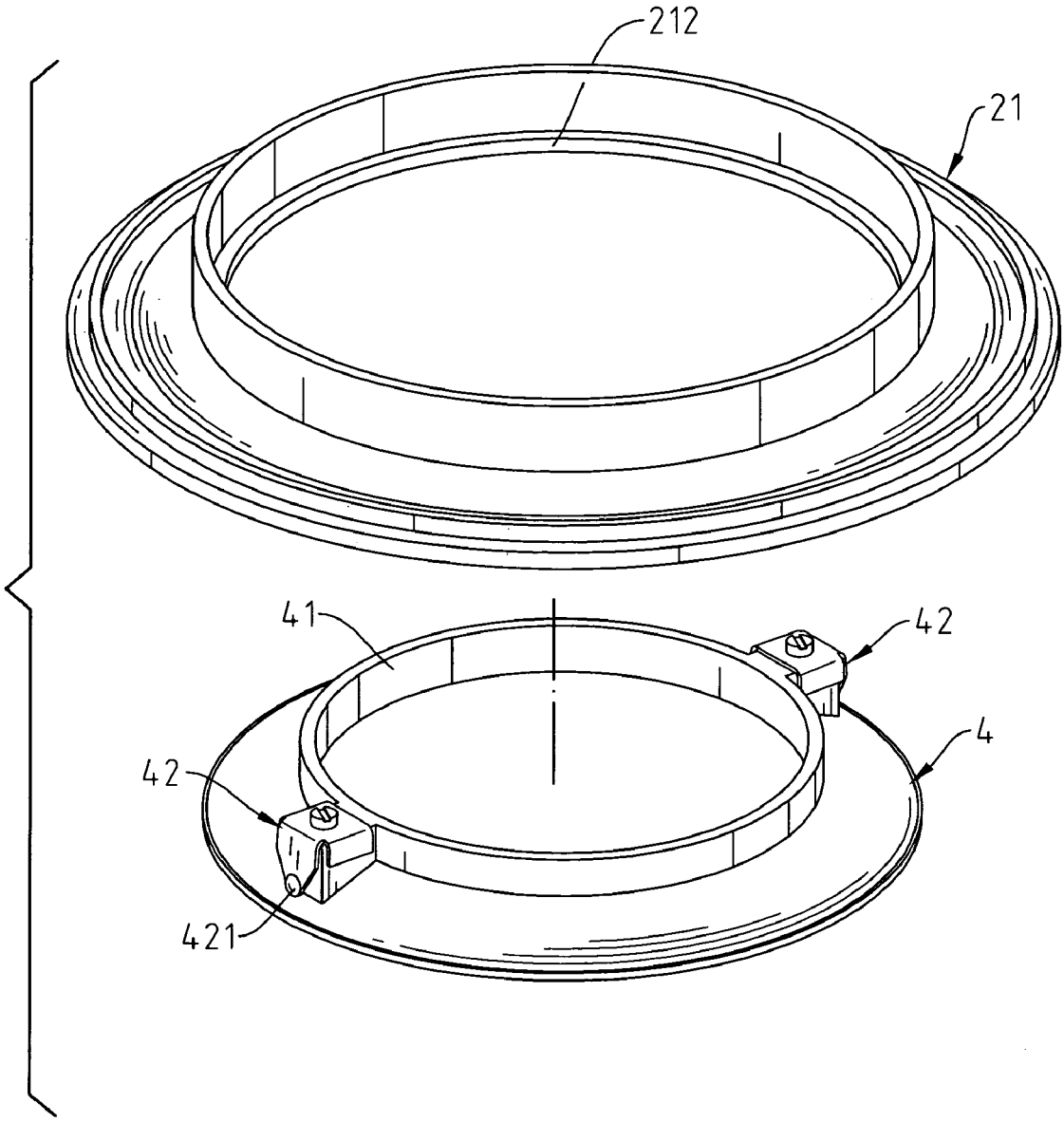
FIG. 4 is an elevational exploded view showing the rotatable bracket and the decorative plate of the present invention.

Referring further to FIG. 3 and FIG. 4, when a light bulb 5 having a smaller diameter than an internal diameter of the embedded bracket 2 is attached to the lamp socket 3, the decorative plate 4 is mounted on the periphery of the light bulb 5 to avoid the gap formed therebetween, wherein the gap is unpleasing to the eye. The decorative plate 4 can be inserted into the rotatable bracket 21 of the embedded bracket 2.

The above-mentioned decorative plate 4 includes a protrudent ring 41 on its internal periphery, wherein the ring 41 further includes at least a pair of buckling means 42 having a pair of protrudent elastic buckles 421 respectively on their exterior portions. When the decorative plate 4 is inserted into the rotatable bracket 21, the pair of protrudent elastic buckles 421 are bounded to buckle the flange 212 and to be positioned thereon.

Figure 5:
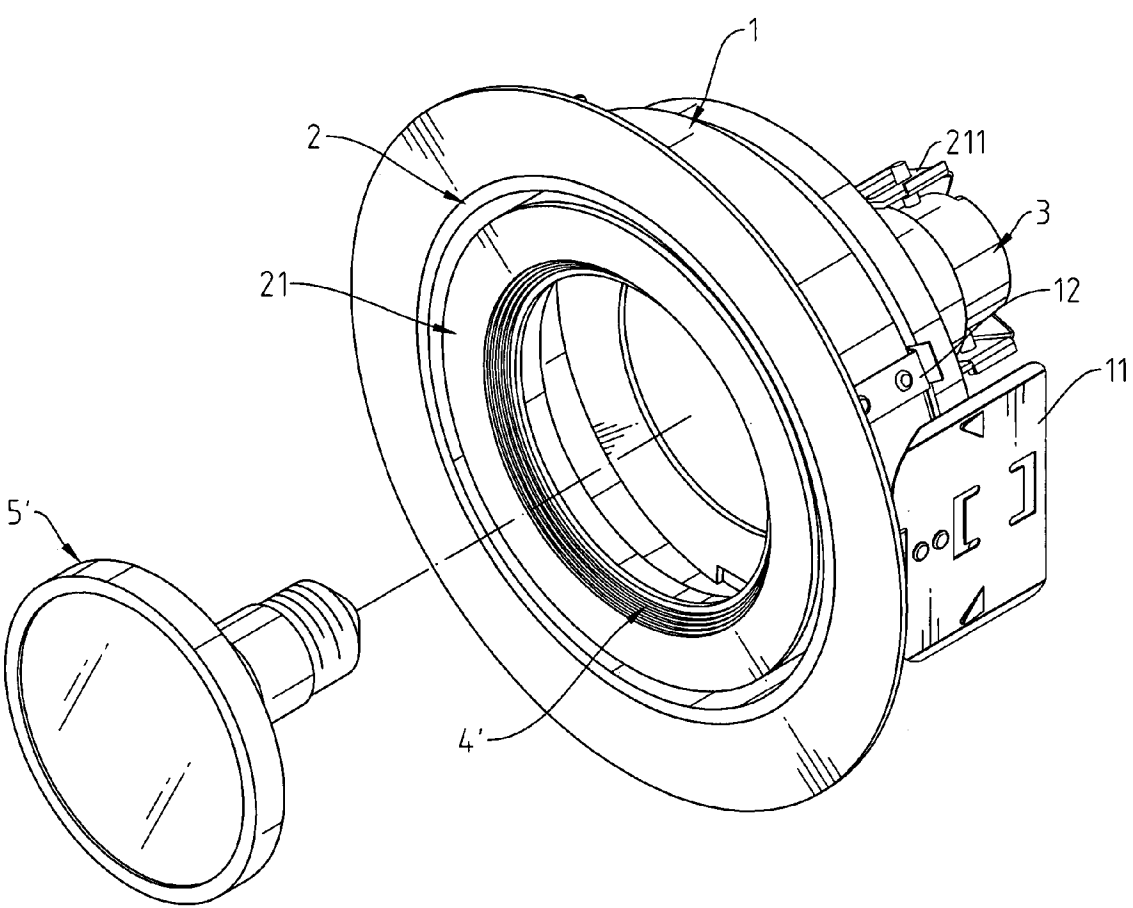
FIG. 5 is an elevational exploded view showing that a larger size light bulb is attached in accordance with the present invention.
Figure 6:
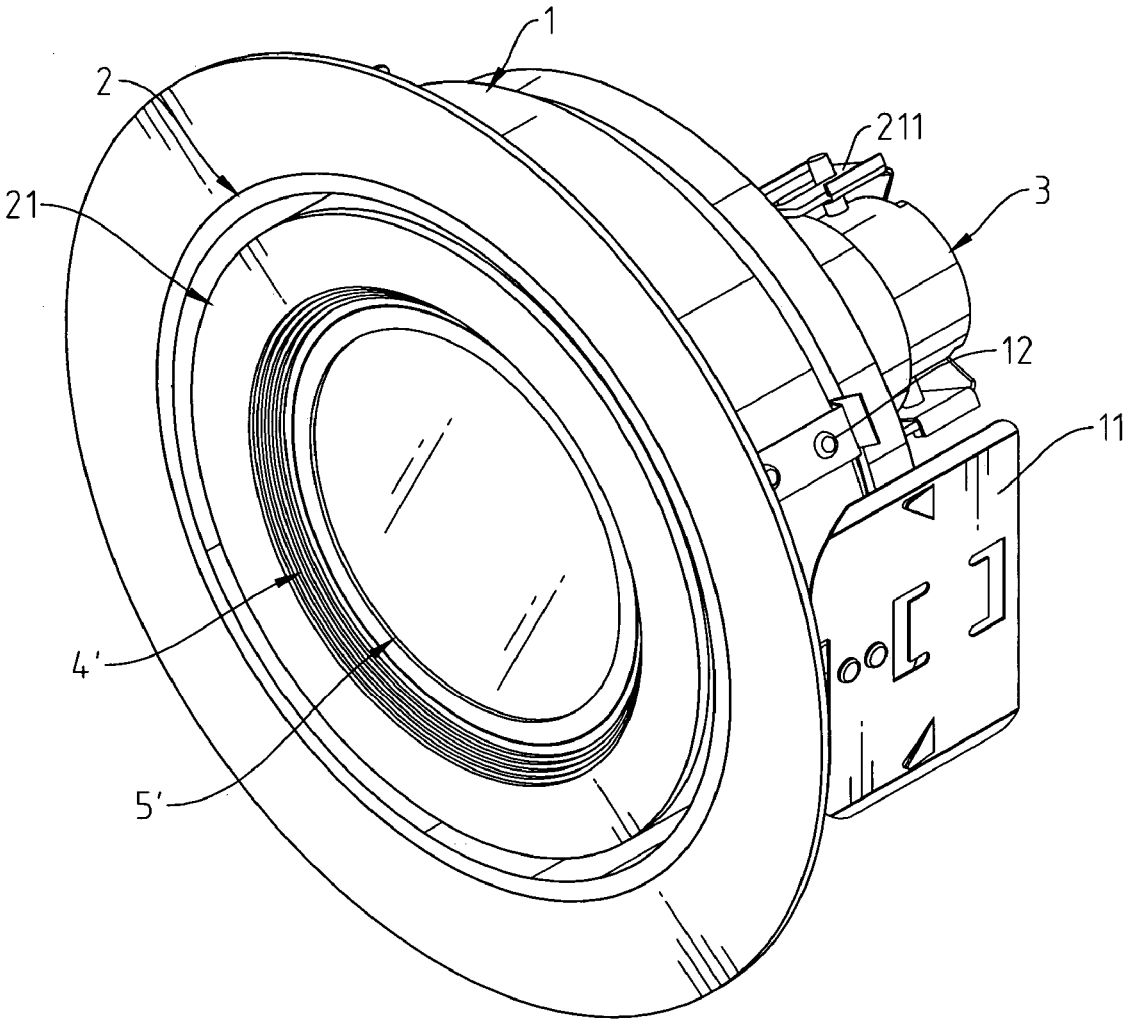
FIG. 6 is an elevational view showing that a larger size light bulb is attached in accordance with the present invention.

When the light bulb is replaced by another light bulb with a larger diameter, the decorative plate must also be replaced by another decorative plate with a larger internal diameter. As shown in FIG. 5 and FIG. 6, the decorative plate 4' can be detached and replaced easily without use of any tool since the decorative plate 4' is merely coupled with the rotatable bracket 21 by use of the protrudent elastic buckles 421. Accordingly, It is very convenient.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

The invention claimed is:

1. A structure of an embedded lamp having a replaceable light bulb, the embedded lamp having a base, an embedded bracket, a lamp socket, and a decorative plate, wherein the embedded bracket is mounted on the inside of the base, a rotatable bracket having two connecting plates on the end thereof for securely connecting with the lamp socket is further mounted on the inside of the embedded bracket, and a light bulb is attached to the lamp socket, characterized in that:

a flange is formed on an internal periphery of the rotatable bracket of the embedded bracket for coupling with the decorative plate; and a protrudent ring having at least a pair of protrudent buckling structures having a pair of protrudent elastic buckles respectively on exterior portions of the protrudent buckling structures is mounted on an internal periphery of the decorative plate, wherein when the decorative plate is inserted into the rotatable bracket, the protrudent elastic buckles are bounded to buckle the flange and to be positioned thereon.

2. The structure of an embedded lamp of claim 1, wherein the decorative plate further comprises a protrudent ring protruding from the internal periphery of the decorative plate.

3. The structure of an embedded lamp of claim 2, wherein the buckling structures adjoin both a lower face of the decorative plate and an outer surface of the protrudent ring.

* * * * *